US005881565A

United States Patent [19]

Coventry

[11] Patent Number: 5,881,565

[45] Date of Patent: Mar. 16, 1999

[54] REFRIGERATION SYSTEM

[75] Inventor: Andrew Coventry, Runaway Bay, Australia

[73] Assignee: Emerald Enterprises Pty Ltd., Perth, Australia

[21] Appl. No.: 737,065

[22] PCT Filed: Apr. 21, 1995

[86] PCT No.: PCT/AU95/00241

§ 371 Date: Dec. 9, 1996

§ 102(e) Date: Dec. 9, 1996

[87] PCT Pub. No.: WO95/29372

PCT Pub. Date: Nov. 2, 1995

[30] Foreign Application Priority Data

Apr. 21, 1994 [AU] Australia ..... PM 5238

[51] Int. Cl.[6] ..... F25B 19/00

[52] U.S. Cl. ..... 62/231; 62/50.2; 62/504; 62/519; 62/524; 62/440; 165/147

[58] Field of Search ..... 62/51.1, 50.2, 62/52.2, 86, 384, 385, 386, 387, 388, 430, 434, 440, 504, 515, 519, 524, 525, 527, 231; 165/146, 147

[56] References Cited

U.S. PATENT DOCUMENTS

| | | | |
|---|---|---|---|
| 1,700,429 | 1/1929 | Bright . | |
| 2,610,472 | 9/1952 | Maxwell . | |
| 3,308,630 | 3/1967 | Fritch, Jr. et al. . | |
| 3,385,073 | 5/1968 | Snelling | 62/52.1 |
| 4,597,271 | 7/1986 | Nof . | |

FOREIGN PATENT DOCUMENTS

| | | | |
|---|---|---|---|
| 6-272998 | 9/1994 | Japan | 165/147 |
| WO 89/07228 | 8/1989 | WIPO . | |

*Primary Examiner*—John M. Sollecito

*Attorney, Agent, or Firm*—Caesar, Rivise, Bernstein, Cohen & Pokotilow, Ltd.

[57] ABSTRACT

A refrigeration system (12) is comprised of three expansion units (19A, 19B, 19C), with each having an expansion chamber (22) and three secondary chambers (24, 26 and 28), connected to a supply (16) of compressed refrigerant. The expansion chamber and secondary chambers are formed with progressively reducing volumetric capacity. The end of each of the the secondary chambers, is connected to a common bleed tube (29) having a bleed hole (34) for venting the refrigerant. The bleed hole opens to the outside of a housing (15) which houses the expansion units. The interior of the housing (15) is filled with a gel which changes state from a liquid to a solid at a predetemmined temperature. A valving arrangement (32) connects the expansion units to a supply of compressed refrigerant. The housing (15) together with a supply (16) refrigerant can be installed into a cooling box for cooling the space within the cooling box. This is achieved by the valve mechanism (32) periodically admitting a volume of compressed refrigerant into the expansion units, wherein the compressed refrigerant initially expands in the expansion chambers. This in turn absorbs heat from the space within the box. The flow of expanded refrigerant through the secondary chambers is retarded by back pressure produced by having the secondary chambers of progressively reducing volumetric capacity. This allows the gel to be maintained at a frozen state for a long period of time while consuming only small volumes of compressed refrigerant.

21 Claims, 2 Drawing Sheets

REFRIGERATION SYSTEM

FIELD OF THE INVENTION

The present invention relates to a refrigeration system.

BACKGROUND OF THE INVENTION

In a conventional closed refrigeration system, refrigerant is circulated through an evaporator and condenser by a compressor. Such refrigeration systems are inherently bulky due to the presence of the compressor and condenser and also have limited portability due to the need to power the compressor by connection with an electrical power source. Also, this type of refrigeration system has limited efficiency due to the need to provide the normal refrigeration cycle of expanding and compressing refrigerant and as the load becomes greater so does the size and power requirements to enable the cooling of the increased load.

It is an aim of the present invention to provide a refrigeration system which does not require connection to an external electrical power source for its operation and utilises a minimum of energy to maintain its operation and does not require a condenser.

SUMMARY OF THE INVENTION

According to the present invention there is provided a refrigeration system comprising:

a housing made of a heat conductive material and locatable in a space to be cooled;

an expansion unit disposed inside said housing and adapted for connection with a supply of compressed refrigerant, said expansion unit comprising an expansion chamber, and said last secondary chamber being in communication with a bleed hole for bleeding refrigerant from said system; and, heat transfer medium wholly contained in and filling said housing and being in thermal communication between said expansion unit and said space via said housing, so that when compressed refrigerant is fed into said expansion chamber, said refrigerant expands and absorbs heat from said heat transfer medium to cool said heat transfer medium and subsequently cool said space.

Preferably said expansion unit further comprises at least one series connected secondary chamber, said chambers having a progressively reduced volumetric capacity from said expansion chamber to a last of said at least one secondary chamber, and said last secondary chamber.

Preferably the volumetric capacity of said secondary chambers is arranged so as to limit the bleeding of said refrigerant to a rate which maintains said heat transfer medium at or below a predetermined temperature.

Preferably said heat transfer medium comprises a material which changes state from a liquid to a solid at said predetermined temperature. Advantageously, said heat transfer medium is a gel.

Preferably said bleed hole is in communication with said surrounding space whereby, in use, refrigerant bled into said surrounding space can expand to absorb heat from said surrounding space.

Preferably said expansion chamber and secondary chambers are in the form of contiguous conduits. Advantageously, said conduits are of equal length.

Preferably, said expansion unit is one of a plurality of expansion units connectable in parallel to a supply of compressed refrigerant.

In one form of the invention, each expansion unit comprises three secondary chambers.

Preferably said refrigeration system comprises a housing for supporting said expansion unit and containing said heat transfer medium.

Preferably said system further comprises valve means for coupling said expansion unit to a supply of compressed refrigerant, said valve means operable for admitting compressed refrigerant from said supply to said expansion unit at selected times.

Preferably said valve means comprises a valve and a controller for opening said valve at predetermined times for predetermined periods.

According to another aspect of the present invention there is provided a refrigeration system for cooling a surrounding space, said refrigeration system comprising:

a housing made of a heat conductive material and locatable in a space to be cooled;

an expansion unit disposed inside said housing and adapted for connection with a supply of compressed refrigerant, said expansion unit comprising an expansion chamber and said last secondary chamber being in communication with a bleed hole for bleeding refrigerant from said expansion unit into said space; and, a heat transfer medium wholly contained in and filling said housing and being in thermal communication between said expansion unit and said space via said housing;

whereby, in use, when compressed refrigerant is fed into said expansion unit, said space is cooled by the absorption of heat from said heat transfer medium by expansion of said refrigerant in said expansion chamber and the expansion of refrigerant in said space bled from said bleed hole.

BRIEF DESCRIPTION OF THE DRAWINGS

An embodiment of the present invention will now be described by way of example only with reference to the accompanying drawings in which.

DETAILED DESCRIPTION OF A PREFERRED EMBODIMENT

Figure 1:
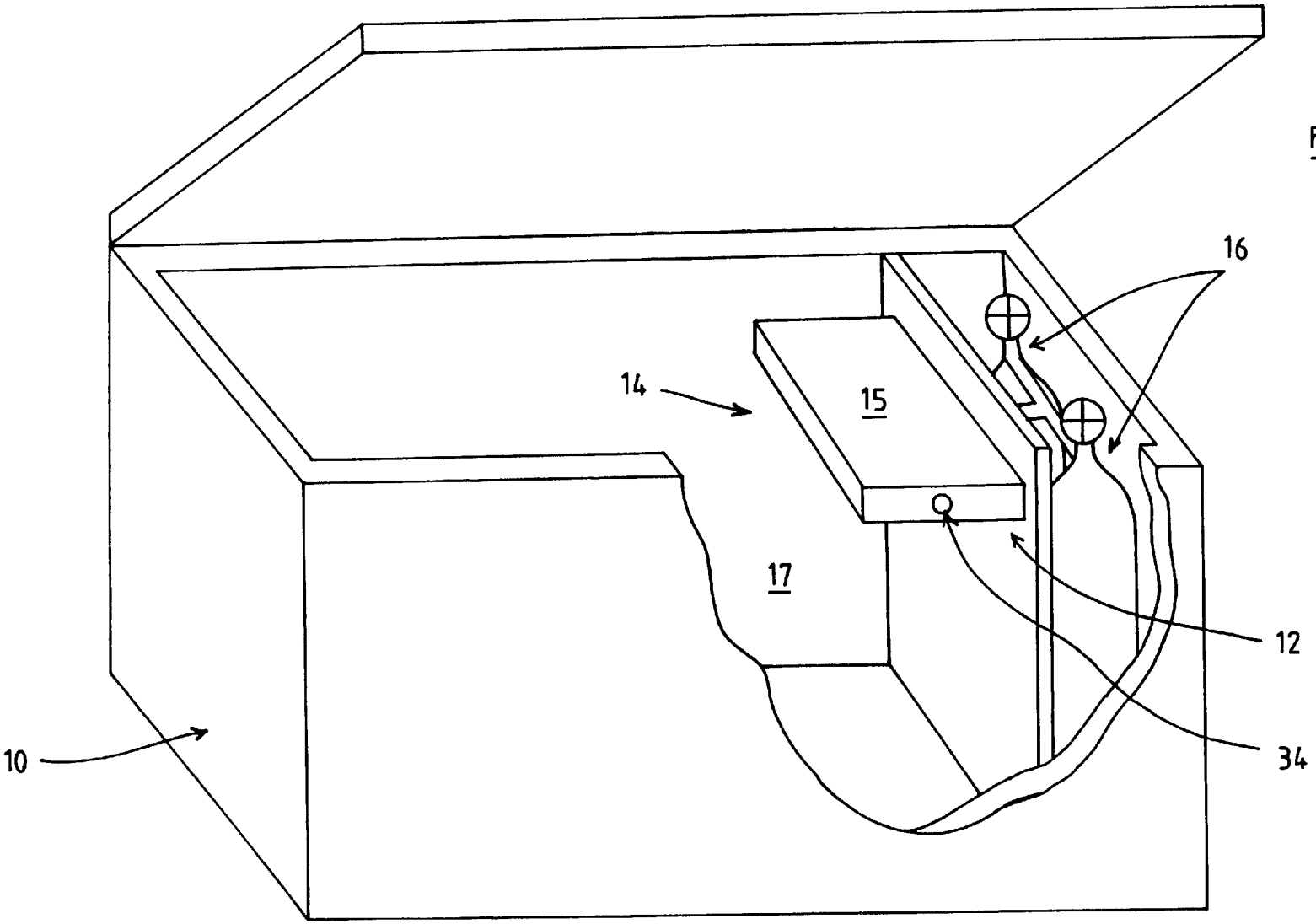
FIG. 1 is a schematic perspective view of a cooling box utilising a refrigeration system in accordance with a preferred embodiment of the present invention; and, FIG. 2 is a schematic perspective view of a refrigeration system in accordance with the preferred embodiment of FIG. 1.

Illustrated in FIG. 1 is a cooling box 10 in which a refrigeration system 12 in accordance with the present invention is installed. The refrigeration system 12 includes a cooling body 14 disposed in a surrounding space 17 and is adapted for connection to a supply of compressed refrigerant such as two bottles 16 containing compressed carbon dioxide.

Figure 2:
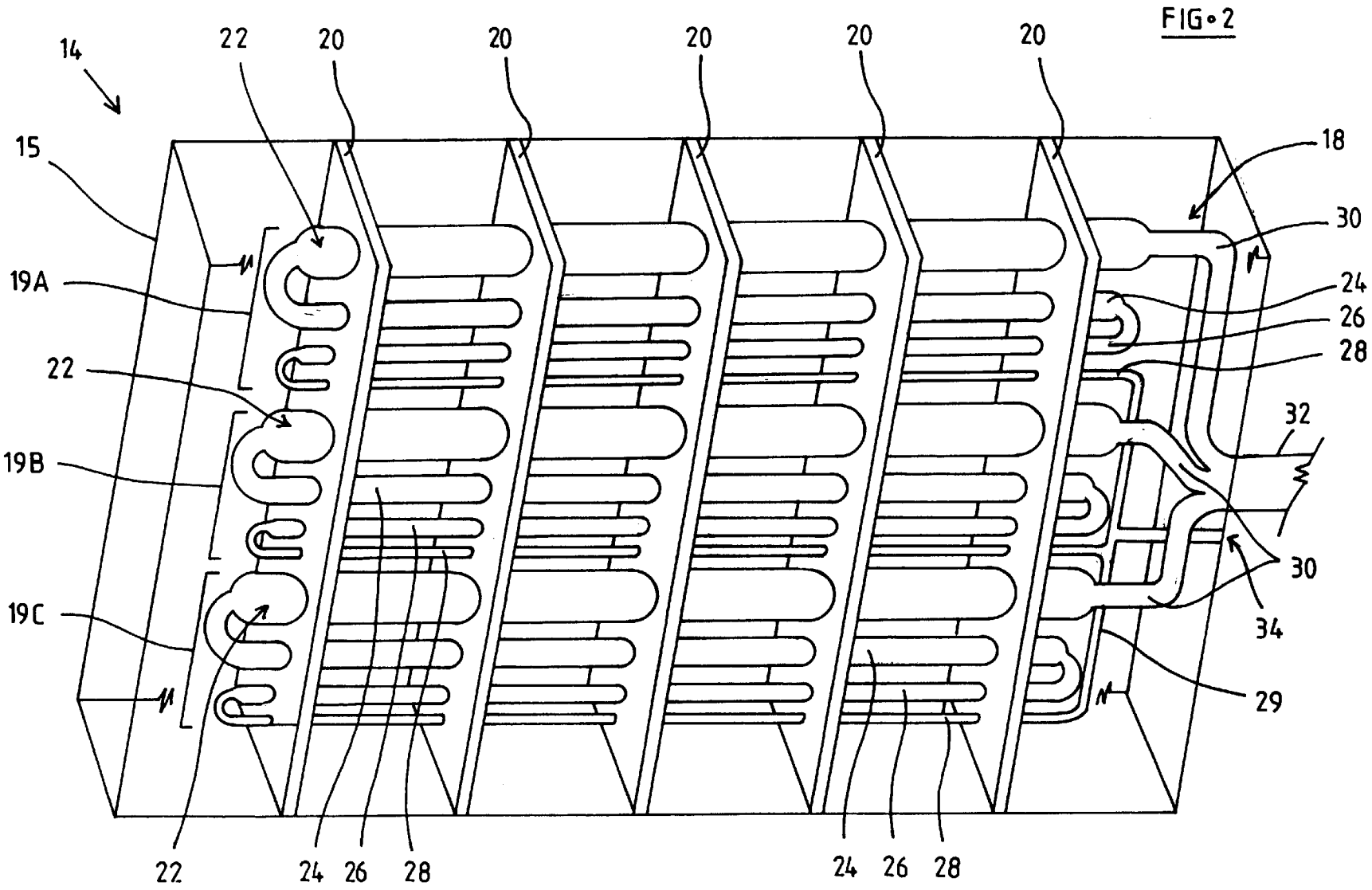

Referring now to FIG. 2, the cooling body 14 is in the form of a rectangular housing 15. The housing 15 defines an internal working chamber 18 provided with a series of spaced apart mutually parallel baffles 20 having apertures therethrough which hold and mount expansion units 19A, 19B, 19C (referred to in general as "expansion unit 19").

Each expansion unit 19 includes an expansion chamber 22 and secondary expansion chambers 24, 26 and 28. As is apparent from FIG. 2, each of the first, second and third secondary chambers (24, 26, and 28 respectively) are of progressively reducing diameters such as to provide progressively reducing volumetric capacities. The chambers 22, 24, 26, 28 are in the form of contiguous conduits or tubes of equal length. The last conduit or chamber 28 in each expansion unit 19 is in communication with a bleed hole 34 via a common T-shaped bleed tube 29. The bleed hole 34 opens onto the outside of the housing 15 to vent refrigerant into the surrounding space 15.

The remaining space within the working chamber 18 is filled with a heat transfer medium, such as a gel, which changes state from a liquid to solid at a predetermined temperature.

Each of the expansion chambers 22 is connected via respective conduits 30 to valve means 32. The valve means 32 is then connected in a suitable manner to the two bottles 16 which contain the compressed carbon dioxide for admitting compressed carbon dioxide from the bottles 16 to the expansion units 19 at selected times.

The valve means 32 includes a valve (not shown) and a controller (not shown) such as a mechanical or electrical timer for opening the valve at preselected times for preselected periods, depending on whether freezing or cooling of the contents of the cooling box 10 is required. More particularly, the valve means 32 can be operated so as to maintain the gel at or below the temperature required to effect a change in its physical state from a liquid to a solid, ie. to keep the gel frozen.

Advantageously, the cooling body 14 is configured so as to be detachable from the refrigerant supply 16 to allow storage in a separate independent freezer until needed. The refrigeration system 12 may then be operated, with the gel pre-frozen, to simply maintain the frozen state of the gel. Of course, the refrigeration system 10 in accordance with the present embodiment is able to freeze the gel itself during normal operation. However, the carbon dioxide would need to be expelled on a more regular basis so as to freeze the gel (in doing so, using more carbon dioxide).

The dimensions of the expansion units will generally be determined by the size of the space to be cooled, as is the number of expansion units and chambers. In this embodiment, for a cooling box 10 of normal dimensions, it is envisaged that the chambers will each be in the order of 400 mm in length, the expansion chamber having a dimension of about 13 mm, while the first, second and third secondary chambers have dimensions in the order of 6 mm, 5 mm and 0.002 mm respectively. The bleed tube 29 also has a diameter of 0.002 mm. Thus, the bleed hole 34 (provided by the open end of the bleed tube 29) is of a small enough size so as to provide an appropriate back-pressure through each of the chambers to ensure that a minimum amount of gas is utilised in maintaining the heat transfer medium in a frozen state. Ideally, the housing 15 is made from a metal of high thermal conductivity such as aluminium or steel.

The preferred gel is of a type that is capable of being frozen or at least of holding a very low temperature, and which is capable of continuing to absorb heat from its surrounding for periods of up to 48 hours at ambient room temperatures without further external cooling being applied to it. Further, the cooling medium preferably has a freezing point in the range of −2° to 2° C. One such gel is CHILLPAK REFRIGERANT GEL 1TSG-15L.

When in operation with the valve means 32 admitting a volume of compressed carbon dioxide to the expansion units 19, the carbon dioxide expands in the expansion chambers 22 to absorb heat via the walls of the chamber from the gel located immediately thereabout. The absorption of heat by the expanding $CO_2$ causes the gel to reduce in temperature at least to a point at which it will freeze, although the temperature will generally decrease further to be well below that. The expanded $CO_2$ then passes into and through the first secondary chambers 24, the volumetric capacity of the secondary chambers being designed such that the volumetric flow rate of the expanded $CO_2$ from the expansion chamber is reasonably slow so as to allow that expanded gas a maximum opportunity to absorb heat from its surroundings.

This process continues through the two further secondary chambers 26 and 28, at each stage providing a greater resistance for the $CO_2$ to flow while the heat absorbing capacity of the $CO_2$ is sufficient to maintain the temperature of the gel below its freezing point. By having the bleed hole 34 within bleed tube 29 which is of identical diameter to the smallest of the secondary chambers (third secondary chambers 28), the volumetric flow rate of expanded refrigerant through the chambers may be controlled to ensure the maximum use of the heat absorbing capacity of the refrigerant.

The gel, via housing 15, is in thermal communication with the space 17 surrounding cooling body 14 and thus cools that space by thermal conduction.

In the present embodiment the refrigeration system 12 is installed in a standard cooler box (such as those of the type known by the trade name "Esky"). In this form, the bleed hole 34 may allow venting of the expanded gas into the space 17 of the cooling box 10, where, because the expanded gas remains under pressure whilst in the third of the secondary chambers, its expulsion through the bleed hole 34 produces a further expansion of the gas and further cooling within the space 17 of the cooling box. This forces the warmer air at the top of the cooling box to be expelled through ventilation ports (not shown) which may be provided in the cooling box. While it will be appreciated that this assists in providing extra cooling within the surrounding space 17, the venting of the expanded gas specifically into the space 17 of the cooling box is not essential.

Thus, heat may be absorbed from within the space 17 of the cooling box 10 through the cooling body 14 and gel and into the cooling medium, where that heat is again transferred into the expanded $CO_2$. By periodically venting the expanded $CO_2$ the heat transferred thereto may be expelled from the system.

By comparison with traditional refrigeration techniques where refrigerant would be expanded and then compressed and recycled, in the above embodiment, the expanded refrigerant is bled or vented from the system.

By providing a plurality of chambers of progressively reducing volumetric capacity, the back pressure on the expanded refrigerant in the expansion chamber may be maintained as the refrigerant passes through each of the secondary chambers. Thus, the heat absorbing capacity of the expanded refrigerant may also be maintained, albeit progressively decreasing slightly through each secondary chamber, such that the refrigerant, as it moves through the secondary chambers, continuously works to absorb heat from the gel surrounding it.

As indicated above, the refrigeration system of the present invention may find many uses. In particular, the system does not require connection to an external electrical power supply, relying on the energy stored in the compressed refrigerant for its operation. This makes the system particularly well suited for recreational refrigeration (caravans, boats remote events, camping, sporting activities, etc.), or for other situations where mobility is required (such as medical and pathology transports, food carriers, mobile military uses).

Finally, it will be appreciated that other modifications and variations may be made to the configurations described herein without departing from the basic inventive concepts. For example, any number of expansion units 19 may be parallel connected to a supply of refrigerant, and each expansion unit 19 may include any number of series connected secondary chambers of progressively reduced volumetric capacity. Also, the refrigerant can include other compressed (and liquefied) gases such as Nitrogen.

All such modifications and variations are deemed to be within the scope of the present invention, the nature of which is to be determined from the foregoing description and the appended claims.

I claim:

1. A refrigeration system comprising:

a housing made of a heat conductive material and locatable in a space to be cooled;

an expansion unit disposed inside said housing and adapted for connection with a supply of compressed refrigerant, said expansion unit comprising an expansion chamber and at least one series connected secondary chamber, said chambers having a progressively reduced volumetric capacity from said expansion chamber to a last of said at least one secondary chamber, and said last secondary chamber being in communication with a bleed hole for bleeding refrigerant from said system; and, a heat transfer medium wholly contained in and filling said housing and being in thermal communication between said expansion unit and said space via said housing, so that when compressed refrigerant is fed into the expansion chamber, said refrigerant expands and absorbs heat from said heat transfer medium to cool said heat transfer medium and subsequently cool said space, wherein the volumetric capacity of said at least one secondary chamber is arranged so as to limit the bleeding of said refrigerant to a rate which maintains said heat transfer medium at or below a predetermined temperature.

2. A refrigeration system according to claim 1, wherein said heat transfer medium comprises a material which changes state from a liquid to a solid at said predetermined temperature.

3. A refrigeration system according to claim 2, wherein said heat transfer medium is a gel.

4. A refrigeration system according to claim 3, wherein said expansion chamber and secondary chambers are in the form of contiguous conduits.

5. A refrigeration system according to claim 4, wherein said conduits are of equal length.

6. A refrigeration system according to claim 5, wherein said expansion unit is one of a plurality of expansion units connectable in parallel to a supply of compressed refrigerant.

7. A refrigeration system according to claim 6, further comprising a bleed tube connected with an end of the last secondary chamber of each expansion unit said bleed tube having an open end defining said bleed-hole.

8. A refrigeration system according to claim 7, further comprising valve means for coupling said expansion units to a supply of compressed refrigerant, said valve means operable for admitting a volume of compressed refrigerant from said supply to said expansion unit at selected times.

9. A refrigeration system according to claim 8, wherein said valve means comprises a valve and a controller for opening said valve at predetermined times for predetermined periods.

10. A refrigeration system according to claim 9, wherein each expansion unit comprises three secondary chambers.

11. A refrigeration system according to claim 10, wherein said bleed hole is in communication with said surrounding space whereby, in use, refrigerant bled into said surrounding space can expand to absorb heat from said surrounding space.

12. A refrigeration system for cooling a surrounding space, said refrigeration system comprising:

a housing made of a heat conductive material and locatable in a space to be cooled;

an expansion unit disposed inside said housing and adapted for connection with a supply of compressed refrigerant, said expansion unit an expansion chamber and at least one series connected secondary chamber having progressively reduced volumetric capacity from said expansion chamber to a last of said at least one secondary chamber, and last secondary chamber being in communication with a bleed hole for bleeding refrigerant said expansion unit into said space; and, a heat transfer medium wholly contained in and housing and being in thermal communication between said expansion unit space via said housing;

whereby, in use, when compressed refrigerant is fed into said expansion unit, said space is cooled by the absorption of heat from said heat transfer medium by expansion said refrigerant in said expansion chamber and the expansion of refrigerant in said space bled from said bleed hole, and wherein the volumetric capacity of said at least one secondary chamber is arranged so as to limit the bleeding of said refrigerant to a rate which maintains said heat transfer medium at or below a predetermined temperature.

13. A refrigeration system according to claim 12, wherein said heat transfer medium comprises a material which changes state from a liquid to a solid at said predetermined temperature.

14. A refrigeration system according to claim 13, wherein said heat transfer medium is a gel.

15. A refrigeration system according to claim 14, wherein said expansion chamber and secondary chambers are in the form of contiguous conduits.

16. A refrigeration system according to claim 15, wherein said conduits are of equal length.

17. A refrigeration system according to claim 16, wherein said expansion unit is one of a plurality of expansion units connectable in parallel to a supply of compressed refrigerant.

18. A refrigeration system according to claim 17, further comprising a bleed tube connected with an end of the last secondary chamber of each expansion unit said bleed tube having an open end defining said bleed hole.

19. A refrigeration system according to claim 18, further comprising valve means for coupling said expansion units to a supply of compressed refrigerant, said valve means operable for admitting a volume of compressed refrigerant from said supply to said expansion unit at selected times.

20. A refrigeration system according to claim 19, wherein said valve means comprises a valve and a controller for opening said valve at predetermined times for predetermined periods.

21. A refrigeration system according to claim 20, wherein each expansion unit comprises three secondary chambers.

* * * * *